US006588358B1

(12) United States Patent
Reynolds

(10) Patent No.: US 6,588,358 B1
(45) Date of Patent: Jul. 8, 2003

(54) MOTION DAMPENED MOORED FLOATING PLATFORM USING PONTOONS WITH BRIDGE ASSEMBLIES

(76) Inventor: Zachary M. Reynolds, 29 W. El Rose Dr., Peraluma, CA (US) 94952

( * ) Notice: Subject to any disclaimer, the term of this patent is extended or adjusted under 35 U.S.C. 154(b) by 0 days.

(21) Appl. No.: 10/089,983

(22) PCT Filed: Oct. 14, 2000

(86) PCT No.: PCT/US00/27722

§ 371 (c)(1),
(2), (4) Date: Apr. 2, 2002

(87) PCT Pub. No.: WO01/25082

PCT Pub. Date: Apr. 12, 2001

(51) Int. Cl.[7] ..... B63B 35/38
(52) U.S. Cl. ..... 114/264; 114/266; 114/267
(58) Field of Search ..... 114/263, 266, 114/267, 264; 405/219; 14/27

(56) References Cited

U.S. PATENT DOCUMENTS 3,091,203 A * 5/1963 Usab
3,665,882 A * 5/1972 Georgiev et al. ..... 114/266
4,043,287 A * 8/1977 Shorter, Jr. ..... 114/266

FOREIGN PATENT DOCUMENTS

EP 0 312 138 A1 * 4/1989

* cited by examiner

*Primary Examiner*—Sherman Basinger
(74) *Attorney, Agent, or Firm*—Larry D. Johnson; Craig M. Stainbrook; Johnson & Stainbrook, LLP

(57) ABSTRACT

A floating platform held in position or moored by lines or piles and providing a suitable landing for vessels for the loading and unloading of passengers and cargo. The floating platform has a configuration of buoyant elements that simultaneously support the platform and combine to reduce and minimize the effects that waves have upon the motions of the landing by distributing wave energy along the length and breadth of the platform in such a way that the energies cancel each other. The buoyant elements of the float are connected by rigid bridge structures that span open volumes which do not provide buoyancy. The distance between the pontoons, or floatation cells, regulates the amount of dampening provided by the system. The bridged gap between the buoyant pontoons is covered by a deck structure capable of supporting any designated design load. The complete deck surface of the landing has a continuous appearance, unbroken by the gap in the floatation cells.

16 Claims, 7 Drawing Sheets

MOTION DAMPENED MOORED FLOATING PLATFORM USING PONTOONS WITH BRIDGE ASSEMBLIES

BACKGROUND OF THE INVENTION

1. Technical Field

This invention relates to floating platforms that serve as landings for vessels, and more particularly to a moored floating platform having a configuration of pontoons and bridge assemblies that reduces platform motions caused by waves and wave phenomena, thereby allowing a more nearly level platform to and from the vessel for passengers and stevedores.

2. Background Art

Floats used for vessel landings are constructed either as walkways, supported at intervals by buoyant cells, or barge-type hulls where the deck of the barge is the landing area. Landings constructed as walkways are typically simple surfaces supported at regular intervals by floatation cells that may be Styrofoam or sealed chambers. The walkways are segmented and connected at joints. Each walkway segment is fitted with one or more buoyant cell. The walkway lands on top of the buoyant cell(s). The landing, acting over the length of the walkway with the buoyant supports, does not act as a structural monolith, where moment and shear loads at one end are transferred to the opposite end. In this sense these landings may be categorized as articulated, such that their components are connected by a series of shear loaded joints which do not transfer moment.

Barge-type hulls act as monolithic structures where moment and shear are transferred through the structure, and loads applied at one extreme end influence the reaction at the other extreme end. These are single structures with internal subdivisions to form tanks and internal boundaries. Variations on this design may include a series of individual pontoons linked together to form a single but composite structure. This type of composite structure links the individual pontoons closely together so that they tie together to form a single barge-like structure. The characteristic of these landing floats is that a continuous buoyant volume is developed along the length of the float body. These floats have the appearance of a barge where the immersed dimensional envelope defines the buoyant volume.

These floating bodies, when acted upon by waves, rock, roll and oscillate on the water surface, generally with six degrees of freedom, namely roll, pitch, yaw, heave, surge and sway. Waves force these bodies to experience motions on the basis of periodicity and wave length. And yet each floating body also has its own natural oscillation period. When the forced wave period and the natural period of the floating body coincide, wave induced loads on the floating body reach maximum amplitudes.

In wave mechanics, the period and wave length are directly related. Short wave lengths have short periods and high frequencies. The effect that a wave form has upon a floating body can also be expressed in terms of the wave length, since period and length are related. Waves that are extremely short, compared to the length of the floating body, will have little effect upon the body. This is due to the fact that the body is being acted upon by a number of waves simultaneously along its length and their net effect is to cancel each other out. The longer the wave length the less the phase differences between competing waves along the length of the body. Long wave lengths, compared to the length of the body, will have a greater effect upon motions.

The wave form exerts a force upon the floating body that is both buoyant and inertial. The buoyant force is created because the wave form elevates or depresses the water profile around the floating body thereby altering the buoyant loads along the body's length. A floating body that encounters a wave crest at the front of the body will experience an upwards load that tends to lift the front relative to the rear. The wave creates a "trimming moment" that tends to trim the front up and the rear down. As the wave creates passes under the body, that trimming moment will eventually cause the rear to trim up and the front down.

In this way the wave form can be seen to create a rocking motion, or pitch, along the length the body. As the wave form passes along the length of the body, it also alters the net elevation of the water level so that the wave tends to lift the body. In this way the wave form can be seen to create an up and down motion, or heave, on the body.

The inertial force is created by the water particles themselves as they move in an orbital path, pushing against the body's surfaces. When the wave front is acting against the front of the floating body, the wave particles are also pushing against the front as they move in their orbit. The push action of the water particles tends to force the front of the body backwards. As the wave passes under the body, the push action of the water particles in the trough of the wave tend to push the body forward. In this way the wave form can be seen to cause a fore and aft motion, or surge, in the floating body. If the wave front acts slightly askew to the alignment of the floating body, the wave particles tend to force the front to one side and then back to the other side as the wave passes under the body. In this way the wave form can be seen to cause a twisting motion, or yaw, in the floating body.

The wave front that strikes the floating body on the side exerts an effect similar to a head on encounter. The wave front buoyant force lifts one side of the body then the other side as the front moves under the body. This creates a rolling motion in the body. The side inertial force of the wave particles tends to push the body sideways, thus creating a swaying motion. As the wave front moves under the body, it also alters the net elevation of the water level so that the wave tends to lift the body, thus creating heave. Where the side wave hits slightly askew, the body tends to yaw.

All floating bodies have natural periods whereby they oscillate in uniform harmonic motion to all six degrees of freedom. Waves force a floating body to experience these motions and the body tends to oscillate at its natural frequency. Wave frequencies that are out of phase with the body's natural period tend to have less effect upon the body's motion than those frequencies that are closer to the body's natural response frequencies.

Motion dampening of a floating body is traditionally of three types. The first is to design a body's natural period to be significantly displaced from the peak period of the design wave form. The second is to develop systems internal to the floating body that respond with counter moments to the buoyant forces that the wave front exerts upon the body. The third is to utilize keels to resist rolling motions.

Each approach has limitations when applied to moored floating platforms. These limitations are a consequence of economic and mass limitations. In simple terms, floating moored vessel landings need to be compact, inexpensive and resilient to vessel impacts. As a consequence, moored vessel landings are traditionally designed as simple cubic structures, described as barges tied off to piles.

The natural period of rolling or pitching of a floating body is dependent upon the distribution of its mass. Basically, when the body rolls or pitches, it describes an arc of rotation about a center, generally located near the center of gravity. The period of the rotation is assumed to be harmonic. According to the laws of simple harmonic motion, or SHM, the period of oscillation is a function of how the mass is distributed about the focal point of the rotation. In a compound body in rotation, the distribution of mass can be assumed to be located at a point from the mass center called the "radius of gyration," or gyradius. The gyradius is the point located from the motion center where the entire mass of the body appears to be located. The position of the gyradius is solved by dividing the mass moment of inertia of the body by its mass and taking the square root of the quotient.

Increasing the mass moment of inertia, and consequently the SHM period, involves increasing the dimensional and cubic measurements of the floating body.

The second method of controlling or dampening body motions is developed on the principal of creating counter moments caused by the transfer of a mass of fluids that opposes the externally created displacement force, such as wave induced motions. These internal forces may be characterized as fluid masses sloshing from side to side in opposition to the frequency and period of wave generated forces. Simply stated the internally confined fluids have a transfer period, from side to side of the floating body, that opposes the externally generated force of the natural wave period. Thus, when the wave period forces one side up, the internally generated slosh of fluids forces that same side down.

A third method of controlling or dampening body motions is to use the resistance of keels to create force in opposition to the rolling motion of the body. In typical barge design. keels are not used, either as centerline keels or bilge keels. This is primarily because of restriction to access of the barge side and the exposed nature of such keel like structures.

Heretofore, conventional designs utilize mechanisms and designs that increase the mass and complexity of the basic hull barge form in order to reduce the effect of externally applied wave forces.

Float designs where the wave front energy is used to alter the periodicity of response and where wave front buoyant loads are altered to change the net trimming or rolling moments is not evident in conventional moored float designs.

It is shown in this invention that a complex solution of motion dampening is possible in the form of an arrangement of buoyant cells connected by bridge assemblies. The inventive solution embodies a disruption of wave induced buoyant loads, period interference. and turbulence drag.

The primary object of this invention is to reduce significantly the response characteristics of a floating platform, making it more stable with less wave induced motions. It is a further object to achieve this first object while also reducing construction and material costs over conventional designs.

Another object of the invention is to teach the design of a system of floating cells that alter the natural response period of the composite floating body.

A further object is to provide a type of floating body where the arrangement of floatation cells interferes with the natural wave period, reflecting portions of the wave front against the original front.

Yet another object is to describe a system of bridge works that provide a rigid system of connected floatation cells that are acted upon by wave forces. The bridges separate the floatation cells so that the frequency of encounter of the wave front to each cell is at odds with the time period with which the wave traverses the bridged gap between cells.

Another object of the invention is to teach the advantage of open spans between buoyant cells where keels may be used as broad, flat and vertical members that also connect the respective cells. These broad flat members set up turbulent eddies and restrict flow by offering a flat resistive keel to lateral, or "rolling," motions.

Still another object of the present invention is to teach the use of broad, flat and vertical members to connect the respective floatation cells, as reflective boundaries to wave fronts approaching from the side. These flat boundaries reflect some percentage of the wave front back upon the advancing front.

Another object of the invention is to teach design procedures that make it possible to install floatation platforms with a minimum of material needed to reduce wave induced motions.

DISCLOSURE OF INVENTION

According to the present invention, a lightweight pontoon assembly can be formed by a sequence or series of floatation cells, every adjoining two cells separated by rigid bridge spans so that the wave induced forces that act upon the pontoon assembly are altered. This alteration of applied force occurs according to the sequence, or spacing, of floatation cells and also alters the periodic response characteristics of the pontoon assembly to the wave energy. The arrangement of floatation cells also creates reflected wave fronts that act against the oncoming wave and reduce the overall wave effect.

In addition, the rigid girders forming the bridges that connect the floatation cells are vertically deep members. These girders create turbulence and eddies as they move against the wave front. The eddies and turbulence create resistance to the wave induced motion as well as opposing wave making, all of which dampens motion.

The pontoon assembly is acted upon by wave fronts that act perpendicular or parallel to the major pontoon axis. A wave front with a direction of motion parallel to the pontoon major axis, or length, causes the pontoon to pitch, surge and heave. A wave front with a direction of motion perpendicular to the pontoon major axis causes the pontoon to roll, pitch, heave, sway and yaw.

In understanding pitching motion, floatation cells should be regarded as independent bodies, each acted upon by a wave front independent of the other cells. The cells may be spaced at such a distance that for a given wave length, hence frequency, the cells experience non-contributory motions. Contributory motions may be defined as those that combine to amplify any of the six freedoms. For example when a given first cell is moving up, a given second cell is moving down. If a line is drawn between the first and second cells, it is seen that the line pitches down. In this case the spacing of the cells enhances a rotational pitching motion relative to the two cells. If the spacing of the cells is such that both exhibit the same vertical motion, then a line drawn between the two cells would show no pitch down or up, so that the cell spacing dampens the pitching motion relative to the two cells.

When the cells are not seen as independent bodies, but rigidly connected, the movement of each influences the movement of the other. Rather than an imaginary line drawn between the cells, it is now proposed that a rigid connection exist between cells. When two cells so connected are acted upon by a wave front and are spaced so that they experience the same vertical motion, the pitching motion of the assembly can be, dampened.

In any arrangement of one or more rigidly connected floatation bodies, the wave profile acting over the length, or major axis, of the arrangement causes its center of buoyancy to oscillate about the midpoint region of the assembly. While the center of gravity of the pontoon assembly remains fixed, the oscillation of its center of buoyancy causes a couple to exist between gravity (downward force) and buoyancy (upward force.) This couple provides the force that generates a pitching motion in the pontoon assembly along the major axis.

For any given wave length, or frequency, the spacing of floatation cells in the pontoon assembly can be set so that the movement or oscillation of the center of buoyancy about mid point is minimized. This in turn minimizes the pitching couple and the resultant motions. The spacing of floatation cells can be expressed as the product of buoyant length and spacing to the square of wave length.

The arrangement of the buoyant cells along the major axis also affects the mass moment of inertia of the pontoon assembly on the major and minor axis. These moments of inertia determine the natural response frequencies, pitching and rolling, in terms of simple harmonic motion.

For a given wave length, a number of floatation cells can be sequentially and rigidly connected at distance combinations where rotational and linear motions are non-contributory between the individual cells. This would cause a uniform dampening of wave induced motions.

The fundamental concept in dampening pitching motion is that the trimming and buoyant forces, summed between the rigidly connected buoyant elements, are minimized due to spacing of buoyant cells distributed along the length of a given wave.

In understanding rolling motion, consider that the non-buoyant structure of the bridge girders is not acted upon by wave forces which cause rolling, pitching and other buoyancy related phenomenon. So that the bridge structure is being forced through the water because it is rigidly attached to buoyant elements. If the bridge structure presents a broad and flat surface which opposes this motion due to resistance, turbulence, eddy making and wave making, similar to a deep keel, then it can effectively dampen the motion it opposes.

In addition each buoyant cell and each bridging girder presents a broad flat surface to wave motion. Because of the dampening characteristics of the present invention these flat surfaces are not moving at the same orbital velocity of the wave particles. This causes some of the wave energy to be reflected off the flat surface and interferes with the primary wave train. This interference pattern can increase the dampening of the wave induced motion by suppressing the energy of the incident wave front.

The second concept is that the natural period of the spaced buoyant cells is significantly displaced from the frequency of the given wave. An extremely narrow body acted upon by a given wave front will experience optimally linear displacements because the small mass moment of inertia and gyradius will displace the natural motion period of rolling or pitching far from the frequency of the given wave. Where the buoyant profile of a body is interrupted, the periodic action of wave force is interrupted, altering the simple harmonic motion response of the body. This may be characterized as an assembly of pendulums acting in series where they impact at out-of-phase intervals.

These float assemblies are designed primarily for use as landings and terminals adjacent to shorelines and beaches. The presence of a shoreline causes a wave front refraction so that the direction of wave motion is bent towards the shore and always tends to be perpendicular to the shoreline. This means that the line of waves created is almost always parallel to the line of the shore. Vessel moorings and landings can be established as piers, where they extend their major axis perpendicular to the shoreline, or as wharves where they extend their major axis parallel to the shoreline. The alignment of the landing determines the principal motion, pitch or roll.

The arrangement of the pontoon assemblies of this invention dampens motions on both the major and minor axis because of the discontinuous arrangement of buoyant cells and their completely rigid connections.

Each category of motion, and motion dampening, is frequency related. A non-dimensional parameter is created which relates dampening functions to the wave frequency. This relational parameter is the ratio of overall pontoon assembly length to wave length, for pitching motions, and overall pontoon assembly width to wave length, for rolling motions.

All wave dampening characteristics are compared to a conventional float where its dimensional envelope is entirely buoyant, and barge like.

BEST MODE FOR CARRYING OUT THE INVENTION

Figure 1:
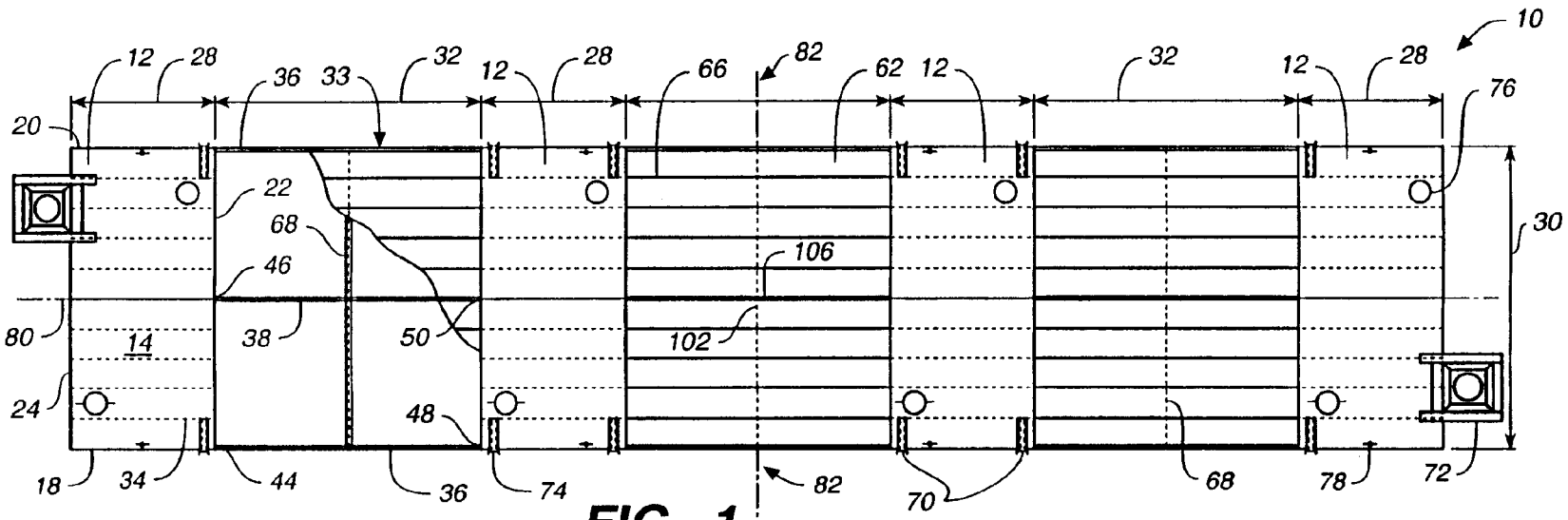
FIG. 1 is a plan view of the motion dampened floating platform of the present invention, illustrating the apparatus with a typical floatation pontoon arranged with at least one other on four in this figure)
Figure 2:
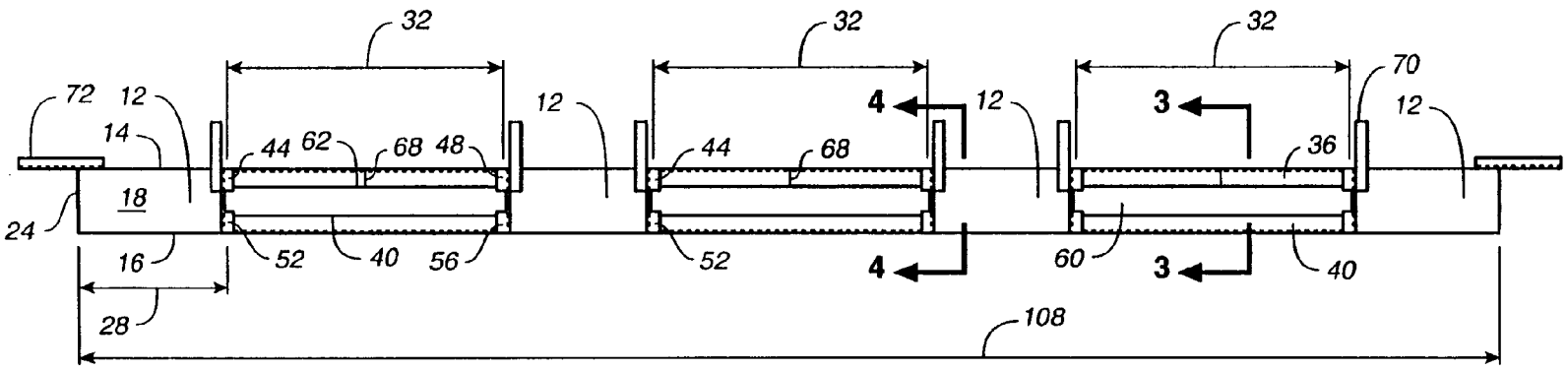
FIG. 2 is a side elevation view of a series of pontoons connected by bridge assemblies.

FIG. 1 is a plan view of the floating platform of the present invention, generally denominated 10 herein, and FIG. 2 is a side elevation view thereof. These views show a typical floatation pontoon 12 arranged with at least one other pontoon, or float, 12 (four are shown in FIGS. 1 & 2). Each pontoon has a plurality of substantially planar or flat sides, preferably six, comprising a top side 14, a bottom side 16, a first end 18, a second end 20, a right 22, and a left side 24. In combination the sides define an interior void 26 which provides buoyancy to the float. Each pontoon has a length 28, a breadth 30, and the pontoons are arranged side-by-side, with a distance 32 separating adjacent pontoons. Each pontoon preferably has an internal structure 34 that contributes to the structural integrity of the floats.

The spaced-apart pontoons are connected over distance 32 by a bridge assembly (33) comprising a system of bridge girders 36, 38, 40, and 42, and a deck 62 assembly. The deck assembly over the bridge at the far left of the FIG. 1 is shown in partial cross section to illustrate the bridge girders. The girders form a bridge between adjacent pontoons 12 and connect the sides and centers of adjacent pontoons. Upper end girders 36 connect the right side of a first pontoon, at the right side upper end junction, or connection point, 44 of a first or second end, and top and right sides of the first pontoon, with the corresponding left side upper end junction, or connection point, 48 of a first or second end, and top and left sides of an adjacent second pontoon; and upper middle girder 38 connects the two pontoons together at the centers, 47 and 50, of the opposing right and left sides, respectively. Girders 36 and 38 connect the top elements of the adjoining pontoons, and are thus termed upper girders. Lower end girders 40 (FIG. 2) connect the lower junction 52 of the first and second ends, top and right sides of the first pontoon, with the corresponding junction 56 of a first and second end, and top and left sides of an adjacent second pontoon; and lower middle girder 42 (FIGS. 11 & 3) connects the two pontoons together via the respective center connection points 54, 58, of their opposing sides at the comer of the top and a side. The upper and lower girders are spaced apart so as to define an opening 60.

Lower girders 40 and 42 (FIG. 11 & FIG. 3) connect the bottom elements of the pontoons so that the top and bottom of adjacent pontoons are joined both by upper girders and lower girders. Upper girders 36, 38, which form the top span between adjacent pontoons 12, also provide the support for a deck assembly 62, which provides a surface for the bridge between the pontoons connected by the girders. The bridge deck assembly 62 includes a surface 64 suitable for foot traffic and is stiffened with structure 66. The bridge deck stiffening structure 66 is supported by a deck girder 68 which connects transversely between upper end girders 36. The bridge deck stiffening structure is also supported by the end structure of each pontoon spanned by the bridge. Side fenders 70 are provided on the comers of each pontoon to absorb impact from vessels making a landing against the pontoon and bridge assembly.

The pontoon and bridge assembly may be moored. Collars 72, which fit around pilings, are provided for installations moored by piles. Lifting eyes 74 are provided at specific locations along the length (108) of the pontoon and bridge assembly to allow the entire assembly to be lifted in one piece. Manholes 76 are provided for entering the pontoon's internal void. Cleats 78 are provided along the sides of the pontoon and bridge assembly so that vessels may tie up to the assembly.

Referring again to FIG. 1, the inventive float assembly is seen to be composed of a plurality of pontoons 12 arrayed such that the sides of adjacent pontoons are substantially parallel to one another and each set of adjacent pontoons is separated by a gap 32 covered by a bridge deck 62 such that the upper surface of the entire platform is a single, continuous surface. However, the platform is supported only by the buoyant pontoons. Any wave form that passes along the major axis 80 in line with the center girders 38 and 42, or passes along the minor axis 82, acts only upon the pontoons. This is contrary to conventional pontoon assembly designs where the assembly is buoyant along its entire length and waves act along the entire length and width rather than separate or discrete elements of length and width. A wave, generally in the form of a sinusoidal curve, has peaks and troughs. The peaks increase buoyant forces and the troughs decrease these forces. If there are more peaks than troughs along the length of a conventional float at any second of the wave passage, an excess of buoyancy exists and an upwards force is exerted upon the float. If the excess of peaks is asymmetrical about the midpoint 102 of the major axis, then this upwards force also becomes a trimming force that causes the float to rotate or pitch about its major axis. For each second of wave passage, the arrangement of peaks and troughs changes over the length, or major axis, of the float. Accordingly, over the passage of time, forces change from an excess of buoyancy to a deficiency of buoyancy. This periodic variation of buoyant forces causes the phenomenon of "heave," where the floating body rises and falls. The periodic variation of buoyancy also causes the center of buoyancy to move forward and aft of the midpoint of the major axis.

The change in the position of the center of buoyancy causes a couple to exist between the center of gravity, which is fixed, and the center of buoyancy. This couple causes the float to "pitch" about is major axis. If the wave train is "regular." meaning a series of waves all of the same period and height, then the buoyancy changes along the length of a uniformly buoyant float are in turn "regular" and periodic, matching the characteristics of the wave profile.

If, as is shown in FIG. 1, the floating platform is not uniformly buoyant and the peaks and troughs of the wave form come into contact with buoyant elements of the float at broken intervals, then the buoyant reactions of the wave form will also be altered from the "regular" pattern of the wave, affecting both heave and pitch.

For any given wave frequency, there is a combination of floats 1I and spacing 32 that results in aminimal wave effect of heave and pitch, Because wave frequency is also expressed as wave length, a parameter of wave influences can be expressed as a ratio of floating platform length to wave length (Lf/Lw.) The influence of the combination of buoyant element and spacing is directly related to wave length and can be related by the product of the buoyant length of the extreme end float and the spacing to the adjacent float divided by the square of the wave length ($Lb \times Ls/Lw^2$.)

The characteristic of pitching is influenced most by combinations of buoyant forces near the float ends. As a consequence, the units of Lb and Ls relate to the first buoyant length (Lp) 28 and first non-buoyant space (L1) 32 at the float ends, respectively. Compared to conventional float design where there are no significant spaces between buoyant elements, where $(Lb \times Ls/Lw^2)=0$, a segmented float, where $(Lb \times Ls/Lw^2)>0$, can be designed for a given range of (Lf/Lw) where pitch and heave are minimized. This range of (Lf/Lw) is developed from the concept that extremely high frequency waves (very short periods and length) have little significant effect upon float motions, and very low frequency waves (long periods and lengths) are not signifcantly influenced by the short to intermediate frequency of spaced buoyancy cells. At some point then, uniformly buoyant floats and segmented floats respond to waves in pitch and heave with little or no significant difference.

A second factor in the spacing of buoyant cells is the distribution of mass about the midpoint (106) of the float assembly. In the analysis of periodic harmonic motion, the distance of the center of mass from the center of rotation, or radius of gyration, determines the periodic rate of oscillation. This rate of oscillation is the frequency of the oscillating mass. When waves act upon a floating body, it is forced to respond at the wave frequency and tends to rotate about its center of gravity. If this forced frequency is different from the natural frequency of the body, determined by its distribution of mass, the body will oppose the forced wave motion. The fundamental premise of the present invention states that buoyant cells and their spacing are arranged to oppose wave frequencies. This arrangement allows the placement of objects of mass, i.e. buoyant cells, at such positions where their natural harmonic frequencies oppose wave frequencies.

The net result of these two modifiers is that float response in pitch and heave can be tuned to be significantly reduced from the response of conventional floats of comparable dimensions.

FIG. 2 is a side elevation view of the float assembly, illustrating how a series of pontoons 12 are connected by upper and lower bridge girders 36, 38, 40, and 42, and showing the junctions, or connection points 46, 50, 54, and 58, whereby the girders connect to adjacent pontoons. The connection points are integral parts of the pontoon. Each pontoon 12 is separated from any adjacent pontoon by a separation distance, gap, or space, 32, The separation distance 32 between pontoons is a specific distance related to the length dimension 28 of the pontoon and the wave lengths that occur in the environment for which the pontoon assembly is designed. The separation distance may vary between the groups of floatation cells that make up the complete assembly. Side fenders 70 and pile collars 72 are shown in profile.

Because of the relationship between the end (outboard) pontoons and their separation distance, the central (inboard) pontoons and their separation distance may not be equal to the end distances. The relationships with other assemblies may allow the float assembly to be asymmetrical about its midpoint for buoyant and non-buoyant spacing.

The bridge girders connect the buoyant pontoon cells in such a way that they form rigid connections between the cells. This is not a system where articulation or movement is allowed between the buoyant cells. Moments and forces developed by buoyancy must be transferred fully between segments in order for the response frequencies to be continuous over the length of the float assembly. The individual floatation cells tend to cancel out each others' motions due to sea response. The bridges help to transmit this dampening force.

The bridge girders span the separation distance 32 between pontoons. The girders are vertically broad and flat, but are separated to define an open space 60 between the girders. The girders may be standard beam sections. The vertical depth 104 of the girders is designed to be approximately equal to the draft of the pontoon assembly. Accordingly, in an installed floating platform, the lower girders (40, 42) are immersed and the upper girders (36, 38) are emerged. This feature allows the surface profile of a wave form having a direction of travel perpendicular to the major axis to pass through the opening (60) between the girders. This decreases the transverse wave forces against the bridge girders so that the major wave forces from the side are against the buoyant cells. Without a uniform side pressure, the movement of the buoyant cells is restricted by the vertically flat keel like resistance of the bridge girders, acting as large braking devices, similar to air brakes on an airplane.

Creating a series of buoyant cells, which in turn support bridges, increases the added mass and consequently the moment of inertia of the float assembly. By increasing the immersed surface area, the virtual mass of the oscillating assembly is increased. This increases the radii of gyration of the assembly and moves the natural response period of the assembly into lower frequencies, away from the higher frequencies which affect float motions.

Figure 4:
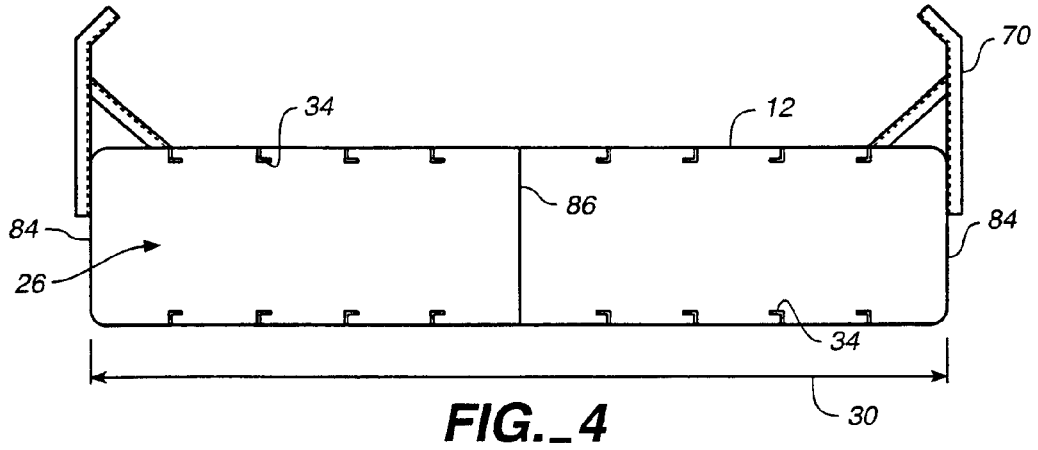
FIG. 4 is detailed cross-sectional view of the pontoon of the present invention taken along Section 4—4 of FIG. 2.

FIG. 4 shows a sectional view cut through a pontoon 12 along the breadth dimension 30. The internal structure 34 of the pontoon is shown. The side structure, or end panel or diaphragm 84, and the centerline structure, or centerline panel or diaphragm 86, are shown as vertical diaphragm or plate elements. The fenders 70 are shown in elevation.

Each pontoon is designed to withstand buoyant forces and to offer the necessary structural rigidity to allow the assembly to function as described. The fender knees, which provide an energy absorbing surface for impact forces from landing vessels, are attached to the buoyant cells. The structure of the cells is designed to withstand the force of impact of landing vessels. The bridge assemblies and bridge girders may be reinforced to withstand side impacts and to support fenders, but the preferred embodiment places the fenders on the buoyant cells.

Figure 5:
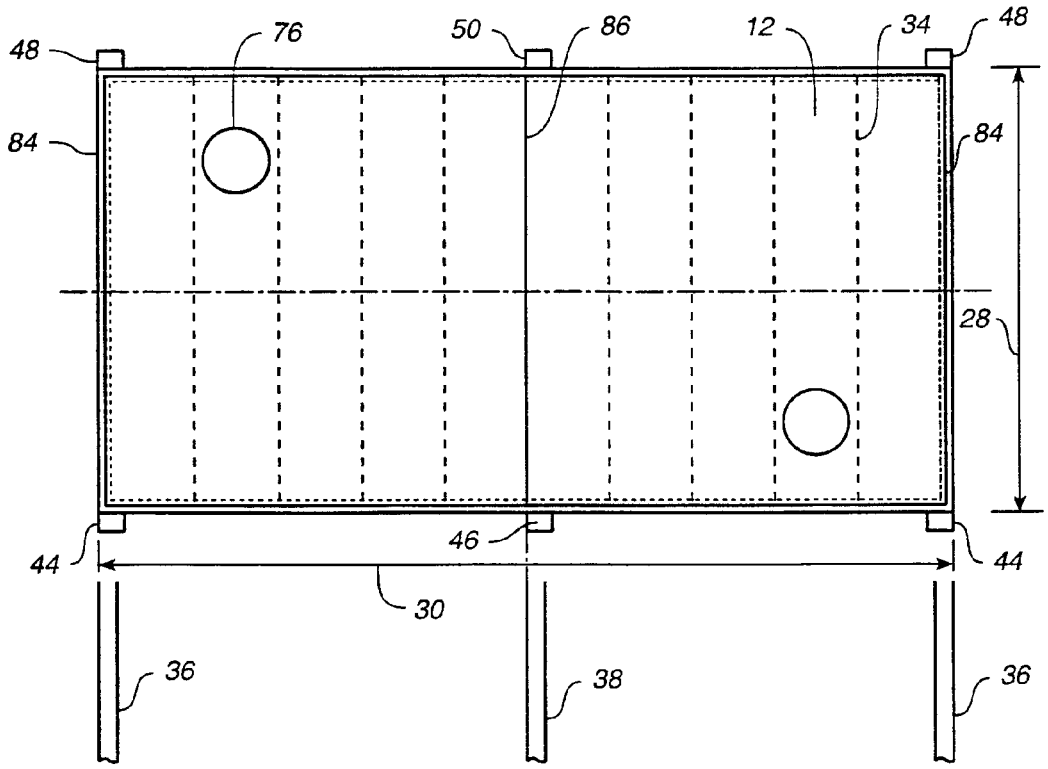
FIG. 5 is plan view of a single pontoon, or bouyant cell.

FIG. 5 shows a plan view of a single pontoon shown in phantom underneath the deck of the pontoon. Right and left side upper connection points 44, 46, 48, and 50 for girders 38 and 38 are shown. The centerline diaphragm 86 and the side diaphragms 84 each have a girder connection point at their extreme ends. The length 28 and the breadth 30 of the pontoon 12 are shown. The internal structure 34 is indicated at typical spacing and the manhole 76 is shown between the structure 34.

Each pontoon, or buoyant cell 12, is constructed so that it is capable of supporting the design buoyancy load as well as the design deck load. This requires internal structure 34. The buoyant cells are also required to support the weight and load moments of the adjacent cells, connected by the bridge girders. This load and moment is resisted by the vertical plate girders 84 and 86, which are a part of the pontoon design (FIGS. 5, 6, 8–11). Each bridge girder 36, 38, 40, and 42, is connected to the buoyant cell by a moment connection 44, 46, 48, and 50 at the ends of the pontoon and in line with the deep internal plate girders 84 and 86.

Figure 6:
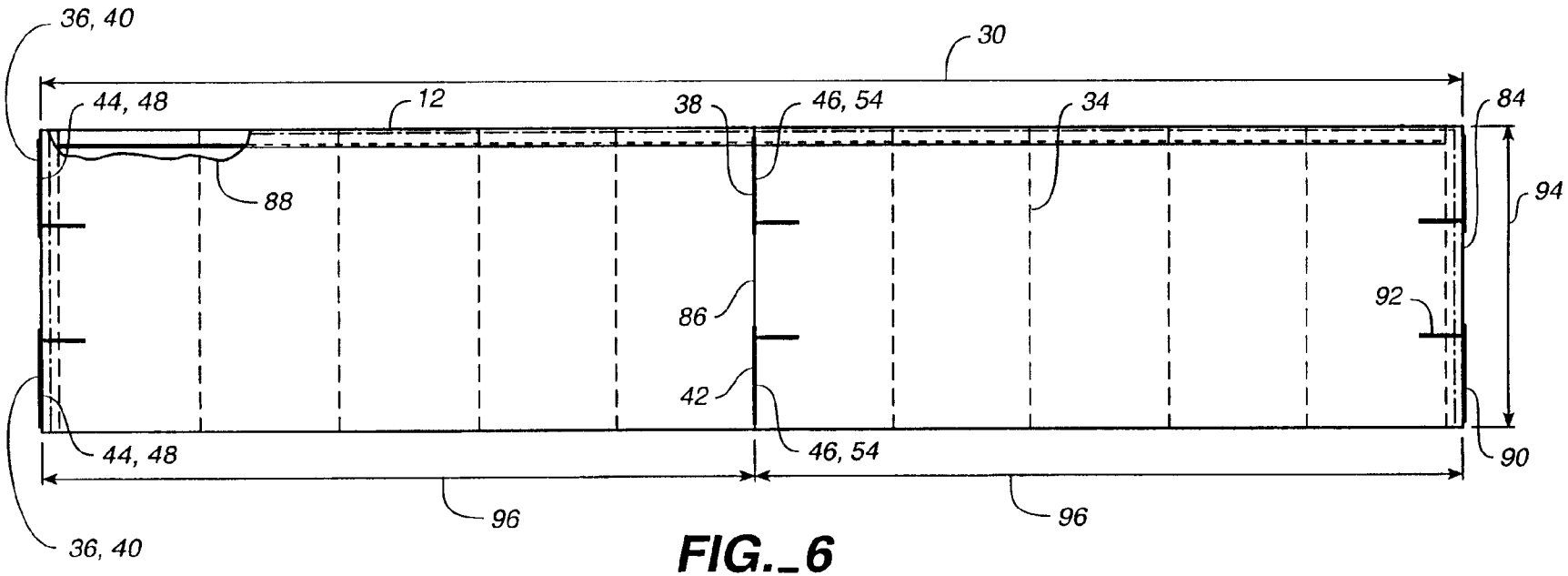
FIG. 6 is a side elevation view of a single pontoon.

FIG. 6 is a side elevation view of the pontoon 12 along the breadth 30 of the float. The internal structure 34 of the pontoon is shown as dotted lines. Girders 36 and 38, and connection points 44, 46, 48, and 50, are shown at the side diaphragm 84 and the centerline diaphragm 86.

Figure 3:
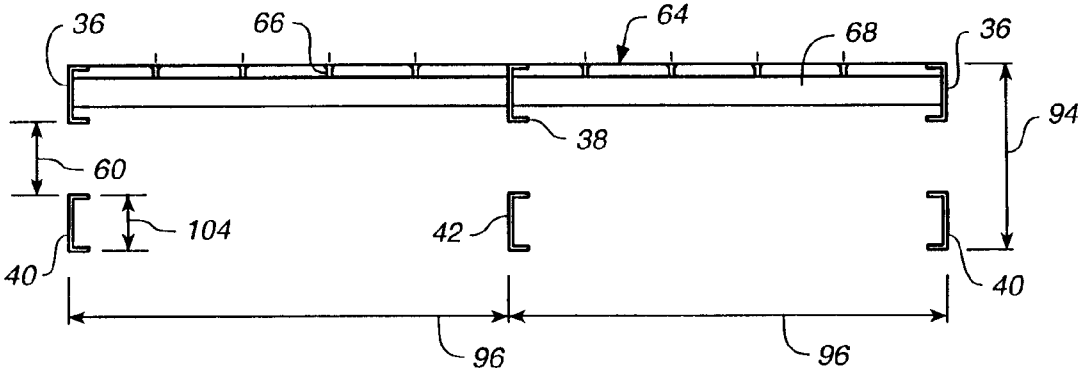
FIG. 3 is a detailed cross-sectional view of the bridge assembly of the present invention taken along Section 3—3 of FIG. 2.
Figure 7:
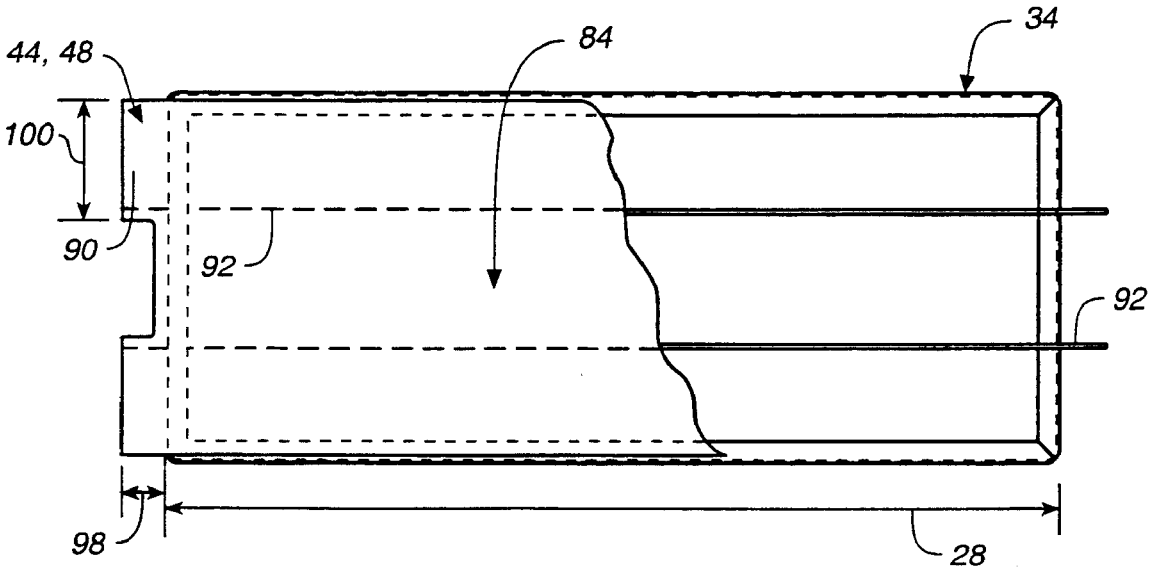
FIG. 7 is a partial cross-sectional end elevation view of the end panel of a pontoon.

As shown in FIGS. 6 & 7, the connection points are composed of vertical elements 90 and horizontal elements 92 A boundary that forms a ledge 88 extends from the ends of the pontoon and acts to support the bridge deck stiffening structure 66 (FIG. 3.) The broad flat surface of each pontoon causes an incident wave to reflect back upon the primary wave form. The bridge girders are connected to each buoyant cell by full moment connections 44, 46, 48, and 50. Each bridge deck is supported by a boundary ledge 88 which is part of the buoyant cell structure.

Referring back to FIG. 3. this view is a sectional view cut through a bridge girder assembly along the section shown in FIG. 2. The stiffening 66 of the bridge deck structure and the bridge deck girder 68 are shown. The side depth 94 of the pontoon 12 and bridge girder assembly, and the half breadth 96 of the assembly establish the location of the girders.

For any given wave profile, approaching from the side, the action of the lower girders, 40 and 42, creates resistance to side motions of roll and sway of the pontoon assembly. These girders, acting as keels, set up turbulence, eddy making, viscous drag and wave making as they are dragged through the water responding to the motion of the buoyant cells of the assembly. This resistance dampens the motions created by wave forces approaching FIG. 6 is a side elevation view of a pontoon shown along the breadth 30 of the pontoon with internal structure 34 indicated in phantom as framing. A detail of connection point 44, 46, 48 and 54, used to connect to girders 36, 38, 40 and 42, shows that the connection point, or bridge tab, is made up of two elements, one vertical element 90 and one horizontal element 92, which create the connecting surfaces, or bracket, for the girders. The horizontal connecting element 92 extends from one end of the pontoon to the other end to the other bridge tab.

Each buoyant cell must act as a rigid element in association with the bridge structure linking the cells. The end plate or panel 84 that comprises the end wall of the buoyant cell also acts as a structure that develops the moment and load carrying ability of the buoyant cell and bridge. The end panel 84 is internal and is capable of establishing the rigidity of the bridge and cell combination. However, rigid elements functionally equivalent to the deep internal plate girders, 84 and 86, may be located anywhere within the buoyant cell structure.

FIG. 7 is a partial cross-sectional end elevation view showing the interior of the end panel 84 and illustrating detail of the connection point, either 44, or 48. This view shows that the vertical element 90 of the connection point extends a distance 98 out from the end and a distance 100 down from top or bottom of the pontoon 12.

Each rigid internal structure 84 and 86 requires connections to the bridge girders that connect the cells and maintain the cell spacing and rigidity of the assembly.

Figure 8:
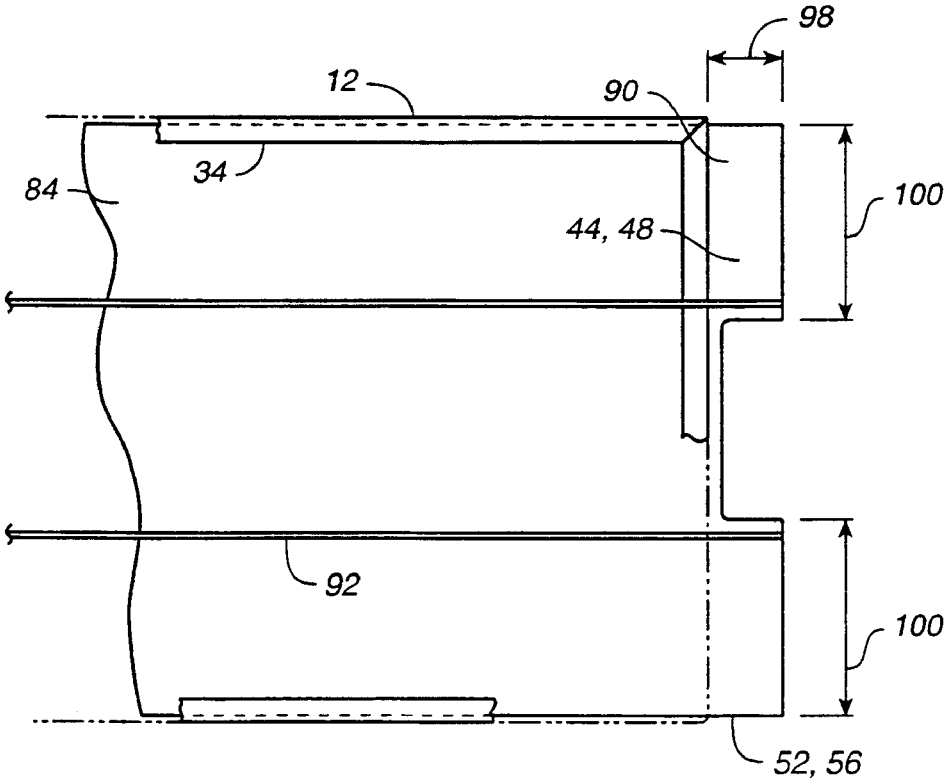
FIG. 8 shows the interior of the centerline panel of a pontoon.
Figure 9:
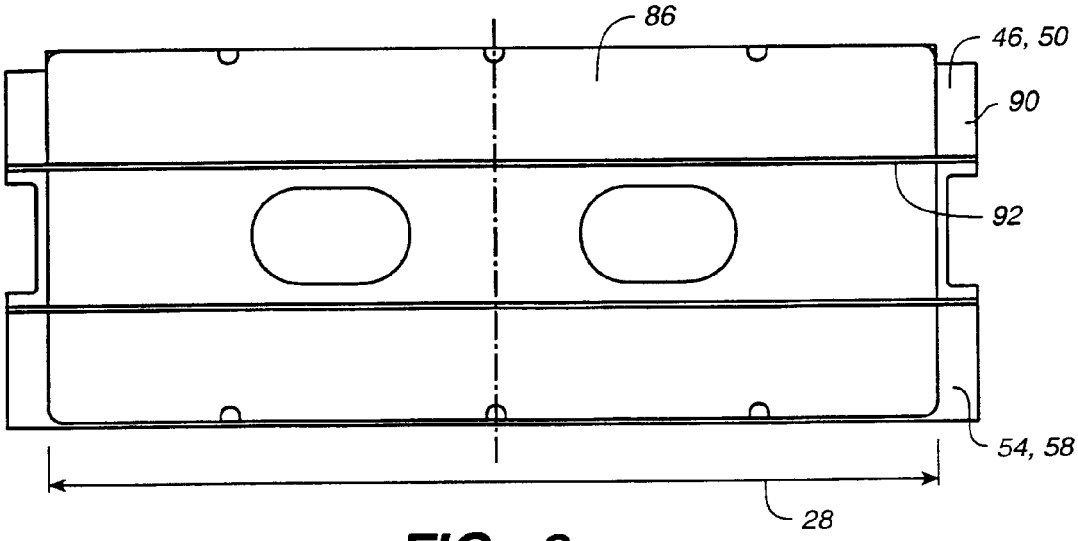
FIG. 9 an elevation view of the interior, or centerline panel of the pontoon.

FIG. 8 is a detailed elevation view of the end panel or diaphragm 84, and FIG. 9 is an elevation view of the centerline diaphragm of a pontoon, each shown along the length 28 of the pontoon. A detail of connection points 44 and 52, or 48 and 56, used to connect to upper and lower end girders, 36 and 40, and connection points 46, 50, 54, and 58, used to connect middle or center girders, shows the vertical and horizontal elements comprising each connection point. The vertical and horizontal elements, 90 and 92, create the connecting surfaces to the girders. The horizontal connecting element 92 extends from one end of the pontoon to the other end to the other bridge tabs.

Figure 10:
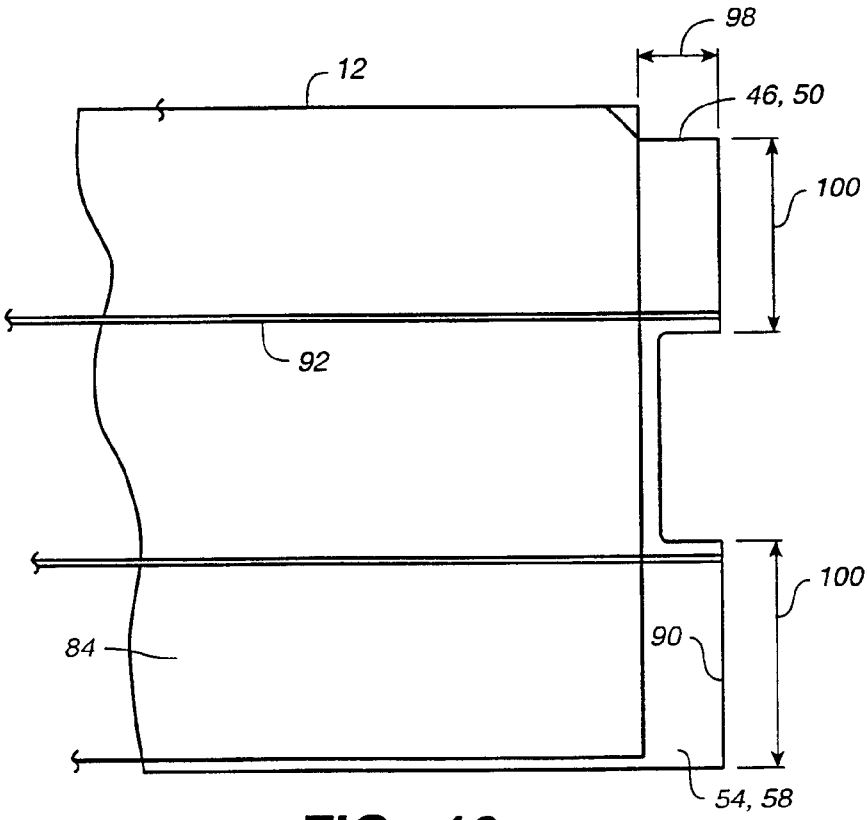
FIG. 10 is a second, detailed view of the centerline panel of the pontoon, particularly illustrating the upper and lower connection points.

FIG. 10 is a detailed elevation view of the centerline panel 86 showing detail of the connections point, either 46 and 54, or 50 and 58, indicating that the vertical element 90 of the connection point extends a distance 98 out from the end and a distance 100 down from top or bottom of the pontoon.

Figure 11:
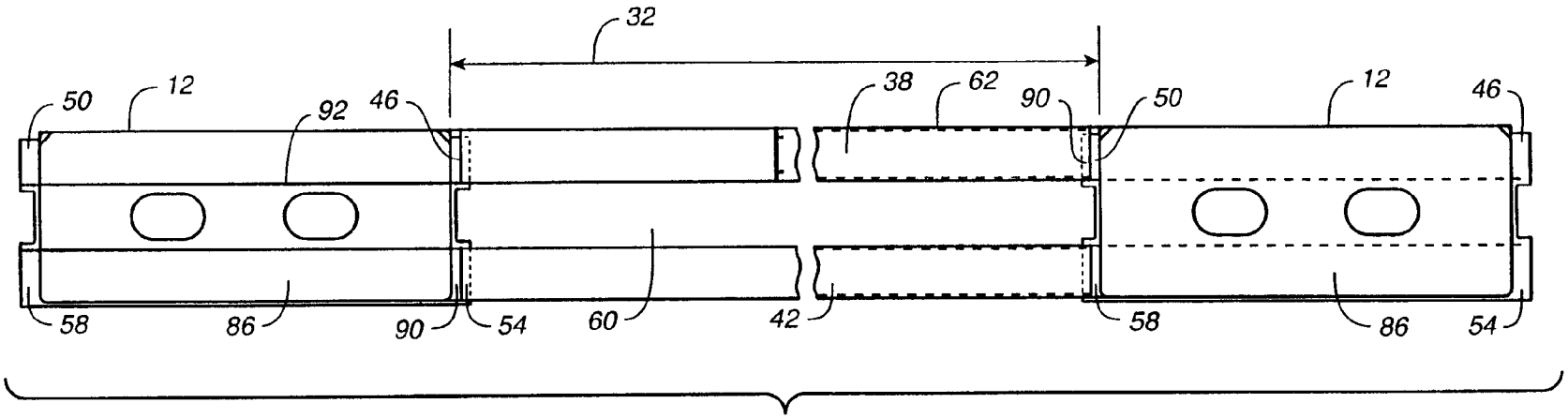
FIG. 11 is a side elevation cross-sectional view of the pontoon and bridge assembly of the present invention, showing at the respective ends variations in the connection points at the bridge girder.

FIG. 11 is a side elevation view of the pontoon and bridge assembly of the present invention, showing at the respective ends variations in the connection points at the upper and lower center bridge girders. The pontoon at the right of FIG. 11 shows the centerline diaphragm 86 of a pontoon in which the connection points 50 and 58 at bridge girders. 38 and 40, lap the girder and the girder edges are hidden (dotted lines.) The vertical element 90 of connection points 50 and 58 laps the girder web. The centerline diaphragm 86 is a continuous part and forms the connection of the connection points 46, 50, 50, and 58 within the pontoon structure.

The pontoon at the left side of FIG. 11 is the reverse image of the pontoon on the right side of the figure. Here the centerline diaphragm 86 of the pontoon is shown where the bridge girders 38 and 42 lap the connection point 46 and 54 and the connection point edges are hidden (dotted lines.) The web of the girders laps the vertical element 90 of connection points 46 and 54. The centerline diaphragm 86 is a continuous part, and forms the connection, of the connection points within the pontoon structure The horizontal connecting element 92 is shown overlapping the flange of center bridge girders 38 and 42, so that each connecting point is shown to overlap or form a continuous connection to and with the bridge girders.

The separation of buoyant elements minimizes response due to wave forces. There is a maximum separation where the effect ceases to be significant. The arrangement of buoyant elements is determined by the prevailing wave length. Reflection of waves against the pontoon side tends to negate the wave energy.

Bridge assemblies are designed to contribute equally to the support of pontoons. Bridge assemblies contribute to the longitudinal support of the pontoons due to arrangements and size. Bridge assemblies allow modular design and manufacture of the float. A single bridge can be reinforced so as to support the entire assembly when the float is lifted at the designated lifting points.

Deck plate over the bridge girders contributes to membrane strength and stabilizes transverse sway. Deck plate requirements can be determined using deep thin web analysis methods.

Figure 12:
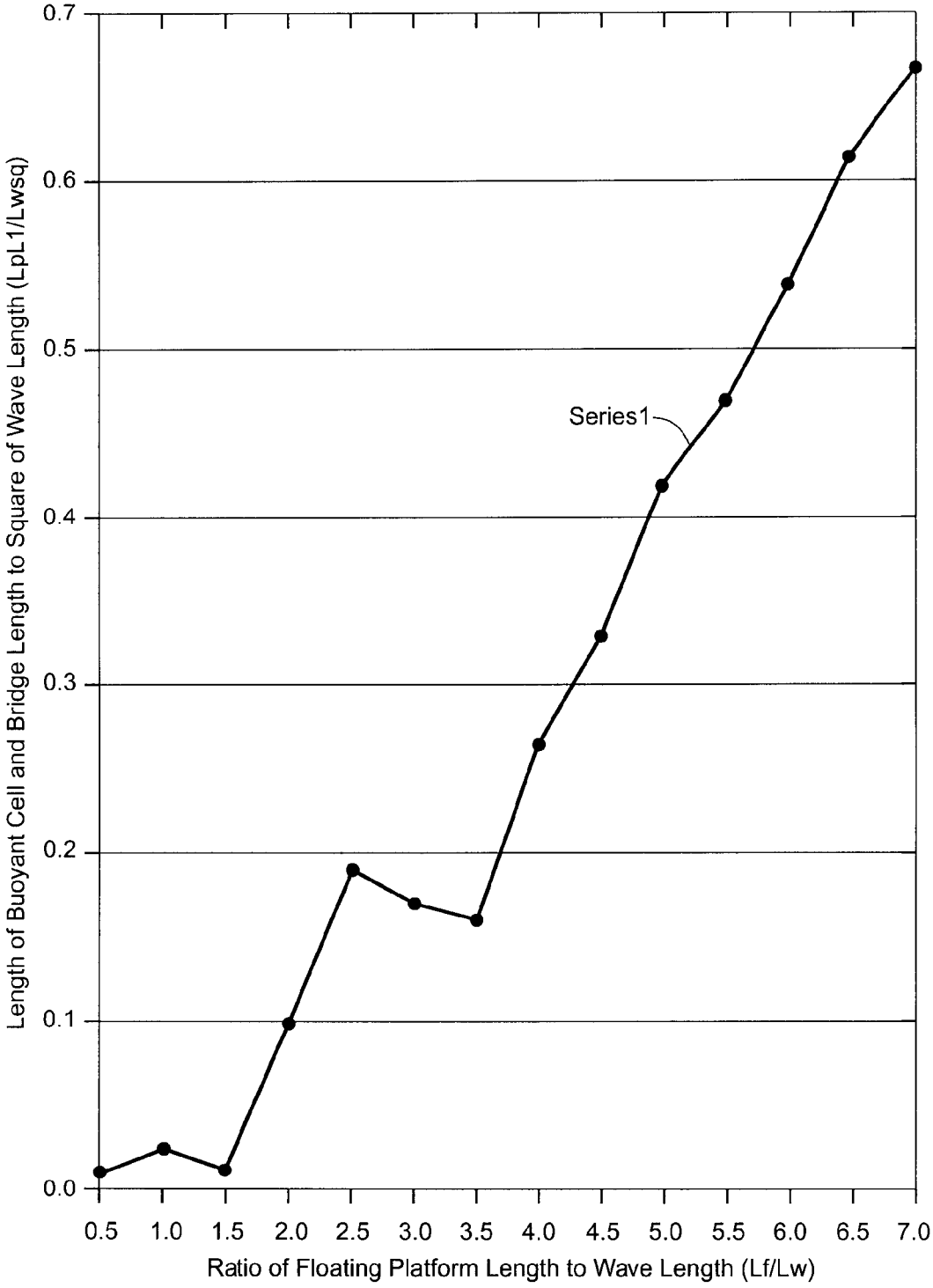
FIG. 12 is a graph depicting the relationship of the length of a buoyant cell at the pontoon assembly's bow or stem relative to the length of the separation between cells for each relative wave length where pitching motion is minimized.

FIG. 12 shows the relationship of the length of buoyant cell (Lp) to the length of the separation between end cells (L1) for each relative wave length where pitching motion is minimized. These are expressed as non-dimensional parameters and as such apply to any length of pontoon assembly. This figure shows that specific characteristics can be identified with minimizing motion responses and can be used to tune any float to the prevailing wave conditions so that float motions are minimized.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A floating platform which dampens wave induced motion caused by waves of length Lw, where Lw is the wave length which defines the environment, said floating platform comprising:

a plurality of buoyant cells, each of said cells having a length (Lp), first and second ends, and plurality of substantially planar sides defining an interior void;

a bridge assembly comprising a girder system interposed between any given pair of adjacent buoyant cells, said girder system including a pair of upper end girders, a pair of lower end girders; each of said lower end girders positioned immediately underneath one of said upper end girders, at least one upper center girder interposed between said upper end girders, at least one lower center girder interposed between said lower end girders, said upper and lower girders forming pairs of upper and lower girders, each pair separated by a vertical space, said bridge assembly further comprising a deck assembly;

wherein said bridge assembly separates each pair of adjoining buoyant cells by a non-buoyant separation distance such that the total length of said platform is greater than ½ Lw and not greater than 7 Lw, and wherein said floating platform conforms to a series of relationships that define the dependency of said length of said buoyant cells to said non-buoyant separation distance, wherein said cells are separated from any adjoining cell by a separation distance L1, and wherein Lp and L1 are expressed as a product LpL1 which is greater than approximately two percent (2%) of the square of the known wave length (0.02 $Lw^2$) and not greater than approximately sixty-eight percent (68%) of the square of the known wave length (0.68 $Lw^2$);

wherein said bridge assembly also rigidly connects each pair of adjoining cells such that the floating platform is non-articulating, monolithic and opposes wave induced motion by virtue of the separation distance between cells; and a plurality of connection points integral to each of said buoyant cells for connecting the ends of said girders to the opposing sides of adjoining buoyant cells.

2. The floating platform of claim 1 wherein said platform has at least two buoyant cells, and wherein said girder system connect said buoyant cells in such a way that they form rigid connections between said buoyant cells, prohibiting articulation and movement and providing for full transfer of moments and forces developed by buoyancy and for moment resistance.

3. The motion dampening floating platform of claim 2 wherein each of said first and second ends of said buoyant cells comprise vertical side diaphragms, and wherein each of said buoyant cells includes a vertical centerline diaphragm.

4. The motion dampening floating platform of claim 3 further including deck assembly stiffening structure, and wherein said side diaphragms and said centerline diaphragms each have vertical elements and horizontal elements, the latter which span from the right side of respective buoyant cells to the left side to form deep internal girders and which extend outwardly from each side of said buoyant cells to form brackets which function as said connection points, which, in the case of said side diaphragms comprise end connection points and in the case of said centerline diaphragms comprise center connection points; and wherein said vertical and horizontal elements form a plurality of boundary ledges which support said stiffening structure for said deck assembly.

5. The motion dampening floating platform of claim 4 wherein said bridge girders are connected to said buoyant cells by a moment connection at the ends of the buoyant cell and in line with said horizontal elements of said side and centerline diaphragms.

6. The motion dampening floating platform of claim 1 wherein in an installed platform the lower girders are immersed and the upper girders are emerged.

7. The motion dampening floating platform of claim 1 having at least three buoyant cells and at least two separation distances, and wherein said separation distances are discontinuous and varied between the groups of buoyant cells that comprise the platform in its entirety, but wherein said floating platform is symmetrical about its midpoint for buoyant and non-buoyant spacing.

8. The motion dampening floating platform of claim 1, wherein said floating platform has at least three buoyant cells and at least two separation distances, and wherein said separation distances between pairs of buoyant cells that comprise the complete assembly are substantially identical and symmetrical, and wherein said floating platform is symmetrical about its midpoint for buoyant and non-buoyant spacing.

9. A motion dampening floating platform which reduces wave induced motion caused by waves of length Lw, where Lw is the ambient wave length identified in the immediate marine environment, said floating platform comprising:

a plurality of buoyant cells, each of said cells having a length (Lp), first and second ends, and plurality of substantially planar sides defining an interior void;

bridge assembly comprising a girder system interposed between any given pair of adjoining buoyant cells, wherein said bridge assembly separates each pair of adjoining buoyant cells by a non-buoyant separation distance such that the total length of said platform is greater than ½ Lw and not greater than 7 Lw, and wherein said floating platform conforms to a series of relationships that define the dependency of said length of said buoyant cells to said non-buoyant separation distance, wherein said cells are separated from any adjoining cell by a separation distance L1, and wherein Lp and L1 are express as a product LpL1 which is greater than approximately two percent (2%) of the square of the known wave length (0.02 $Lw^2$) and not greater than approximately sixty-eight percent (68%) of the square of the known wave length (0.68 $Lw^2$); and a plurality of connection points integral to each of said buoyant cells for connecting the girder system to the opposing sides of adjoining buoyant cells.

10. The motion dampening floating platform of claim 9, wherein said bridge assembly includes girder system comprising a pair of upper end girders, a pair of lower end girders, each of said lower end girders positioned immediately underneath one of said upper end girders, at least one upper center girder interposed between said upper end girders, at least one lower center girder interposed between said lower end girders, said upper and lower girders forming pairs of upper and lower girders, each pair separated by a vertical space, said bridge assembly further comprising a deck assembly.

11. The motion dampening floating platform of claim 10, wherein said bridge assembly rigidly connects each pair of adjoining cells such that the floating platform is non-articulating, monolithic and opposes wave induced motion by virtue of the separation distance between cells.

12. The motion dampening floating platform of claim 9, having at least three buoyant cells and at least two separation distances, wherein said separation distances are discontinuous and varied between the groups of buoyant cells that comprise the platform in its entirety, but wherein said floating platform is symmetrical about its midpoint for buoyant and non-buoyant spacing.

13. The motion dampening floating platform of claim 9, wherein said floating platform has at least three buoyant cells and at least two separation distances, and said separation distances between pairs of buoyant cells that comprise the complete assembly are substantially identical and symmetrical, and wherein said floating platform is symmetrical about its midpoint for buoyant and non-buoyant spacing.

14. The motion dampening floating platform of claim 10, wherein in an installed platform the lower girders are immersed and the upper girders are emerged.

15. The motion dampening floating platform of claim 9 wherein said plurality of buoyant cells are arrayed such that the sides of adjacent buoyant cells are substantially parallel to one another and wherein said deck surface is a single, continuous surface.

16. The motion dampening floating platform of claim 9 wherein the assembly is supported only by the buoyant pontoons.

* * * * *